US012264563B1

(12) United States Patent
Greci et al.

(10) Patent No.: US 12,264,563 B1
(45) Date of Patent: Apr. 1, 2025

(54) FLOW CONTROL DEVICES FOR HYDROGEN PRODUCTION FROM WELLBORE

(71) Applicant: Halliburton Energy Services, Inc., Houston, TX (US)

(72) Inventors: Stephen Michael Greci, Little Elm, TX (US); Ryan W. McChesney, Prosper, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 3 days.

(21) Appl. No.: 18/369,421

(22) Filed: Sep. 18, 2023

(51) Int. Cl.
*E21B 43/16* (2006.01)
*E21B 34/06* (2006.01)

(52) U.S. Cl.
CPC ..... *E21B 43/16* (2013.01); *E21B 34/06* (2013.01)

(58) Field of Classification Search
CPC ..... E21B 43/14; E21B 43/16; E21B 34/08; E21B 34/06; E21B 43/12; E21B 34/14; E21B 43/02; E21B 43/24; E21B 43/295; E21B 43/34; F03G 7/04
See application file for complete search history.

(56) References Cited

U.S. PATENT DOCUMENTS 5,145,003 A * 9/1992 Duerksen ..... E21B 43/305 166/50
7,198,107 B2 * 4/2007 Maguire ..... E21B 43/2605 166/272.2
8,714,266 B2 5/2014 Dykstra et al.
8,763,697 B2 7/2014 Surguchev et al.
9,080,410 B2 7/2015 Dykstra et al.
10,061,329 B1 * 8/2018 Coulston ..... E21B 34/08
10,208,574 B2 * 2/2019 Least ..... E21B 43/086
11,105,183 B2 8/2021 Frosell et al.
11,493,145 B2 11/2022 Fripp et al.
11,543,049 B2 1/2023 Greci et al.
(Continued)

FOREIGN PATENT DOCUMENTS

WO 2022126257 A1 6/2022

OTHER PUBLICATIONS

PCT/US2023/033014, "International Search Report and the Written Opinion", May 30, 2024, 13 pages.
(Continued)

*Primary Examiner* — Daniel P Stephenson
(74) *Attorney, Agent, or Firm* — Kilpatrick Townsend & Stockton LLP

(57) ABSTRACT

A system can be used to recover hydrogen from a geological formation. The system can include a first flow control device and a second flow control device. The first flow control device can be positioned in a wellbore, which can be positioned in a geological formation, to control flow of a first material based on one or more first fluid properties of the first material. The second flow control device can be positioned in the wellbore offset from the first flow control device to control flow of a second material based on one or more second fluid properties of the second material. The second material can be different than the first material and can include hydrogen. The flow of the first material and the flow of the second material can be controlled in response to wellbore fluid being injected into the geological formation to enhance a hydrogen-producing reaction.

20 Claims, 5 Drawing Sheets

(56) References Cited

U.S. PATENT DOCUMENTS

| | | | | |
|---|---|---|---|---|
| 2005/0239661 | A1* | 10/2005 | Pfefferle | E21B 43/243 507/100 |
| 2011/0005752 | A1 | 1/2011 | Huang et al. | |
| 2013/0277058 | A1 | 10/2013 | Huang | |
| 2015/0300327 | A1 | 10/2015 | Sweatman et al. | |
| 2022/0397021 | A1 | 12/2022 | El Mallawany et al. | |

OTHER PUBLICATIONS

Osselin, F., et al., "Orange Hydrogen is the New Green", 2021, 21 pp.

* cited by examiner

FLOW CONTROL DEVICES FOR HYDROGEN PRODUCTION FROM WELLBORE

TECHNICAL FIELD

The present disclosure relates generally to wellbore operations and, more particularly (although not necessarily exclusively), to flow control devices for hydrogen production from a wellbore.

BACKGROUND

Wellbore operations may include various equipment, components, methods, or techniques to form a wellbore, to displace and release produced material, such as hydrocarbons, water, and the like, using a wellbore or flowline, and the like. A wellbore can be formed or otherwise positioned in a subterranean formation or other suitable geological formation that may include hydrogen deposits or other deposits that have a potential for forming hydrogen. Recovering hydrogen from the formation via the wellbore may be technically challenging.

DETAILED DESCRIPTION

Figure 1:
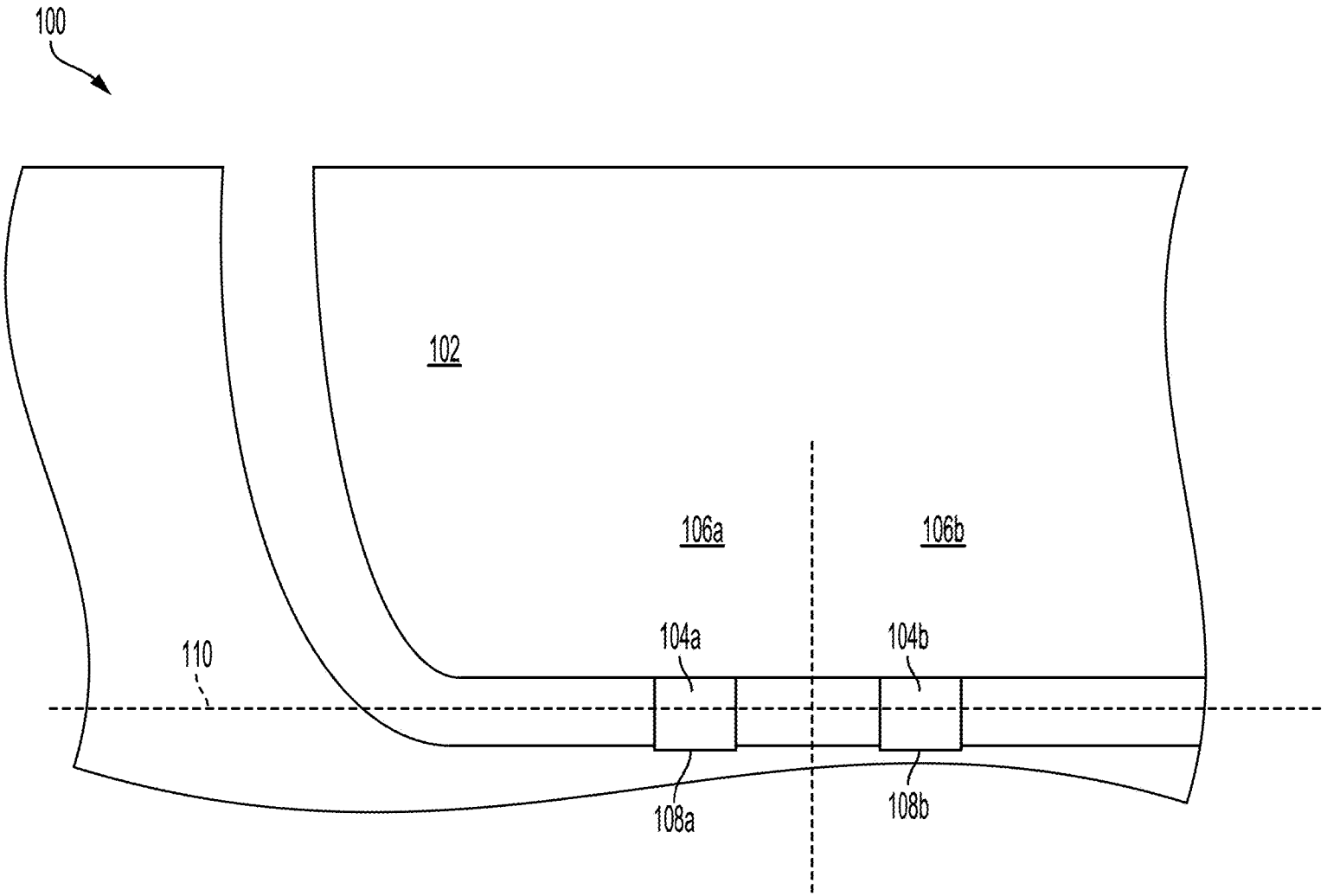
FIG. 1 is a block diagram of a wellbore that can be positioned in a geological formation that includes hydrogen or hydrogen-producing components according to one example of the present disclosure.

Certain aspects and examples of the present disclosure relate to flow control devices that can be used to recover hydrogen from a geological formation using a wellbore. The wellbore may be formed or otherwise positioned in the geological formation, which may be or include a subterranean formation, a suboceanic formation, or any other suitable geological formation that may include hydrogen or hydrogen-producing components. The flow control devices may include one flow control device, two flow control devices, three flow control devices, four flow control devices, one hundred flow control devices, or more flow control devices. The flow control devices can be used to inject wellbore fluid into the geological formation to enhance a reaction that may take place in the geological formation. In some examples, the reaction may cause hydrogen to be produced, to be stored in the geological formation, to be emitted from the geological formation, etc. The flow control devices can be used to recover hydrogen from the geological formation. For example, the flow control devices can choke or otherwise restrict production of non-hydrogen or low-hydrogen material while encouraging production of hydrogen gas or hydrogen-rich material.

Massive amounts of hydrogen may be present in the earth's crust, trapped in the earth's crust, emitted from the earth's crust, etc. For example, as much as 150 trillion metric tons of hydrogen may exist in the earth's crust. This hydrogen may be referred to as geological hydrogen. The geological hydrogen may form in iron-rich pockets of water near fault lines where the water may be exposed to olivine formation rock ($Fe_2SiO_4$). The geological hydrogen may be recovered, for example using a wellbore and related tools, but the recovery may also generate substantial volumes of produced brine that may complicate recovering the geological hydrogen. For example, the produced brine may be processed, reinjected, and the like, which may increase a time for producing the geological hydrogen, an amount of resources used for producing the geological hydrogen, a capacity for producing the geological hydrogen, and the like.

A wellbore that includes one or more flow control devices can be used to enhance recovery of the geological hydrogen. The one or more flow control devices may include one flow control device, two flow control devices, three flow control devices, four flow control devices, or more than four flow control devices. In some examples, the one or more flow control devices can be or include a density automatic inflow control device, an electric inflow control device, a viscosity automatic inflow control device, a nozzle inflow control device, other inflow control devices, or any combination thereof. A density automatic inflow control device can be or include a flow control device that can automatically determine to encourage flow of a material or restrict flow of the material based at least in part on a density of the material. For example, the density automatic inflow control device can receive a material and can encourage flow of the material if a density of the material exceeds a threshold density.

A viscosity automatic inflow control device can be or include a flow control device that can automatically determine to encourage flow of a material or restrict flow of the material based at least in part on a viscosity of the material. For example, the viscosity automatic inflow control device can receive a material and can encourage flow of the material if a viscosity of the material exceeds a threshold viscosity. An electric inflow control device can be or include a flow control device that can measure, such as directly or indirectly, a composition of a material to determine whether to encourage or restrict flow of the material. For example, the electric inflow control device can receive a material and can use one or more sensors to measure or otherwise determine a composition of the material to determine whether to encourage or restrict flow of the material. Additionally or alternatively, the one or more flow control devices may include a nozzle control device that can inject material, such as wellbore fluid, into the geological formation from the wellbore.

The one or more flow control devices can determine, or can otherwise be used, to choke a material, to produce a material, or the like. For example, a first flow control device may receive a first material, may determine, such as via one or more sensors, etc., that the first material does not include hydrogen, includes a small concentration (e.g., less than approximately 50%, less than approximately 40%, less than approximately 30%, less than approximately 20%, less than approximately 10%, etc.) of hydrogen, or the like and may choke or otherwise restrict production of the first material. Additionally or alternatively, the first flow control device, or a second flow control device, may receive a second material, may determine, such as via one or more sensors, etc., that the second material includes hydrogen at or above a threshold hydrogen concentration (e.g., greater than approximately 50%, greater than approximately 60%, greater than approximately 70%, greater than approximately 80%, greater than approximately 90%, approximately 100% etc.) and may encourage production of the second material.

In some examples, the one or more flow control devices may inject wellbore fluid into the geological formation to stimulate or otherwise enhance production of geological hydrogen. The wellbore fluid may be or include water, brine, artificial wellbore fluid, or any combination thereof. The one or more flow control devices may be or include a nozzle inflow control device that can be used to inject the wellbore fluid into the geological formation. The wellbore fluid may interact with the geological formation, or any component or compound included therein, and may cause geological hydrogen to be formed, emitted, or the like. For example, the wellbore fluid may stimulate or enhance the following reaction:

$$3Fe_2SiO_4+2H_2O \rightarrow 3SiO_2+2Fe_3O_4+2H_2 \quad \text{(Equation 1)}$$

which may be or involve an olivine reaction with water or other suitable materials.

Using a density automatic inflow control device, a viscosity automatic inflow control device, an electric inflow control device, a nozzle inflow control device, other types of inflow control devices, or any combination thereof can optimize flow in a wellbore. For example, the set of flow control devices can be arranged in the wellbore or otherwise used to minimize flow of brine, hydrocarbon material, non-hydrogen-containing material, and other unwanted production material. Additionally or alternatively, the set of flow control devices can be arranged in the wellbore or otherwise used to enhance production of geological hydrogen or other production material that may include hydrogen gas. In a particulate example, a target material, such as geological hydrogen, may be produced using a density automatic inflow control device valve that may be positioned in the wellbore to choke hydrocarbon material, such as oil or gas, or brine and may produce the target material. In another example, a fluidic diode, or an electric inflow control device, may be positioned in the wellbore to restrict brine, hydrocarbon material, such as oil or gas, and the like, and to produce geological hydrogen based on the electric inflow control device measuring the target material.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a block diagram of a wellbore 100 that can be positioned in a geological formation 102 that includes hydrogen or hydrogen-producing components according to one example of the present disclosure. The wellbore 100 can be formed in the geological formation 102 or otherwise positioned in the geological formation 102 for controlling flow of target material from the geological formation 102. In some examples, the geological formation 102 may be or include a subterranean formation, a suboceanic formation, or other suitable geological formation. The target material may be or include geological hydrogen, hydrogen-containing material, lithium-rich brine, alkali-metal-rich brine, water, hydrocarbon material, and the like. Additionally or alternatively, the wellbore 100 is illustrated as a substantially horizontal wellbore, but the wellbore 100 may be any other suitable shape or orientation such as a vertical wellbore, an offset wellbore, a curved wellbore, and the like.

The wellbore 100 can include downhole tools 104*a-b*, which may be positioned downhole in the wellbore 100. The downhole tools 104*a-b* may be or include flow control devices, isolation devices, or other suitable types of downhole tools that can be positioned and used in the wellbore 100. For example, the downhole tools 104*a-b* may be or include a packer, an inflow control device, such as a density automatic inflow control device, an electric inflow control device, etc., or other suitable downhole tool that can be positioned in the wellbore 100. In a particular example, the first downhole tool 104*a* can be or include a first electric inflow control device, and the second downhole tool 104*b* can be or include a second electric inflow control device. In another example, the first downhole tool 104*a* can be or include a first density automatic inflow control device, and the second downhole tool 104*b* can be or include a second density automatic inflow control device. In another example, the first downhole tool 104*a* can be or include a first type of inflow control device, and the second downhole tool 104*b* can be or include a second type of inflow control device.

The downhole tools 104*a-b* can be positioned offset in the wellbore 100. For example, the wellbore 100 may include or may define isolated zones 106*a-b*, and the downhole tools 104*a-b* may be positioned in corresponding isolated zones of the isolated zones 106*a-b*. The first downhole tool 104*a* may be positioned at a first location 108*a* in the wellbore 100, and a first isolated zone 106*a* of the wellbore 100 may surround the first location 108*a*. Additionally or alternatively, the second downhole tool 104*b* may be positioned at a second location 108*b* in the wellbore 100, and a second isolated zone 106*b* of the wellbore 100 may surround the second location 108*b*. The first location 108*a* may be offset from the second location 108*b* in a direction that follows the path of an axis 110 of the wellbore 100.

The downhole tools 104*a-b* may be used to control flow of one or more materials with respect to the wellbore 100, the geological formation 102, or a combination thereof. For example, the first downhole tool 104*a*, the second downhole tool 104*b*, or a combination thereof may inject fluid, such as wellbore fluid, into the geological formation 102 to stimulate production of one or more materials from the geological formation 102. Additionally or alternatively, the first downhole tool 104*a*, the second downhole tool 104*b*, or a combination thereof may receive one or more materials from the geological formation 102. The one or more materials may be or include hydrocarbon material, brine, geological hydrogen, other suitable hydrogen-containing materials, or the like. The first downhole tool 104*a*, the second downhole tool 104*b*, or a combination thereof may determine whether to produce or choke the one or more materials based on properties associated with the one or more materials. For example, the first downhole tool 104*a* may receive a first material and determine to choke the first material based on a density, a viscosity, a composition, or other suitable property of the first material. Additionally or alternatively, the second downhole tool 104*b* may receive a second material and determine to produce the second material based on a density, a viscosity, a composition, or other suitable property of the second material.

Figure 2:
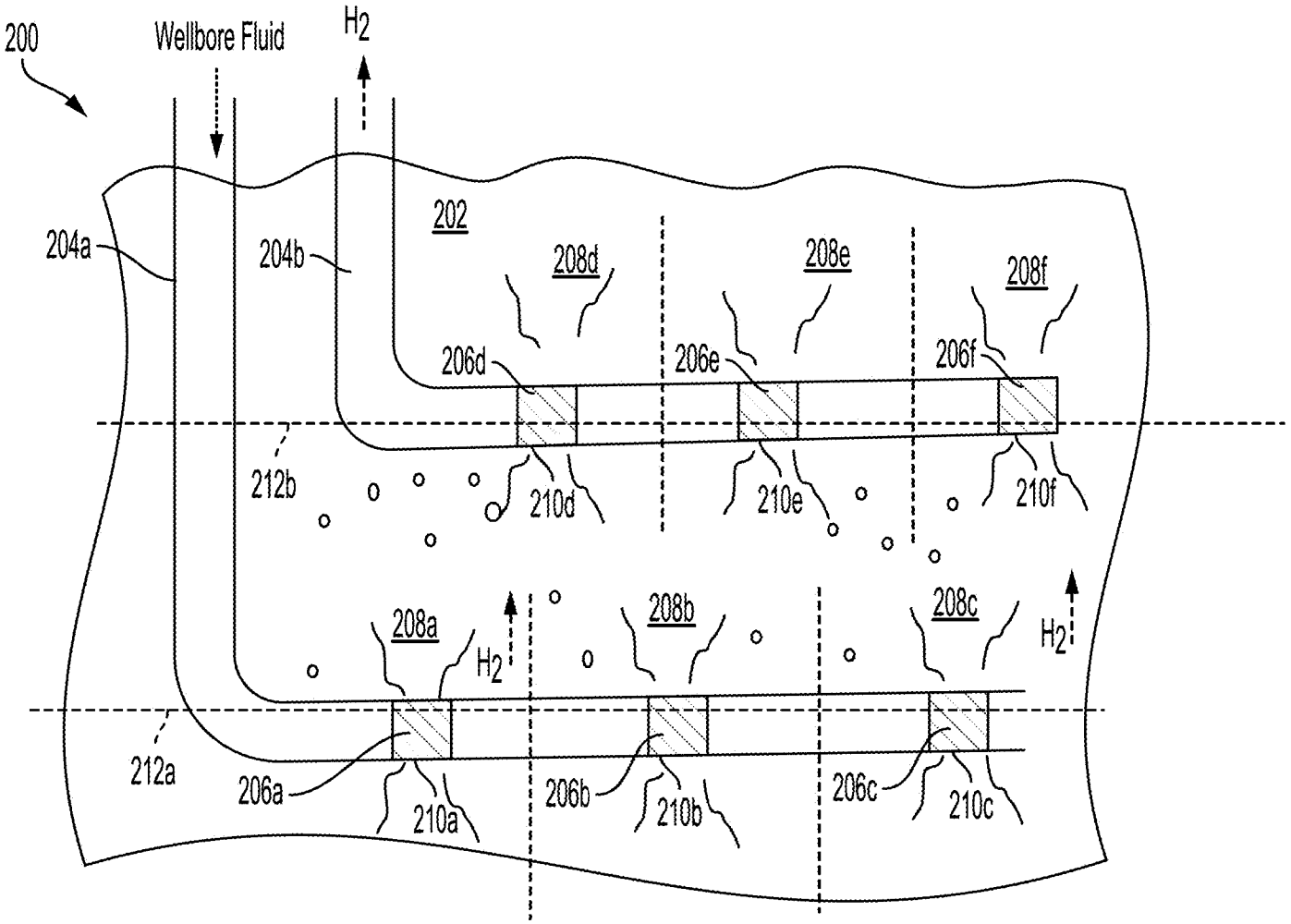
FIG. 2 is a diagram of a wellbore with a set of flow control devices that can be used to produce hydrogen from a geological formation according to one example of the present disclosure.

FIG. 2 is a diagram of a set of wellbores 200 with a set of flow control devices that can be used to produce hydrogen from a geological formation 202 according to one example of the present disclosure. The set of wellbores 200 may include a first wellbore 204*a* and a second wellbore 204*b*, though the set of wellbores 200 may include different numbers (e.g., less than two or more than two) of wellbores for facilitating hydrogen production from the geological formation 202. The set of wellbores 200 can be formed in the geological formation 202 or otherwise positioned in the geological formation 202 for controlling flow of target material with respect to the geological formation 202. Although the geological formation 202 is illustrated and described as being or including a subterranean formation, the set of wellbores 200 may additionally or alternatively be positioned in a suboceanic formation or other suitable type of geological formation for controlling flow of the target material. The target material may be or include geological hydrogen, brines, such as lithium-rich brine, alkali-metal-rich brine, etc., water, hydrocarbon material, and the like. Additionally or alternatively, the set of wellbores 200 are illustrated as being substantially horizontal wellbores, but the set of wellbores 200 may be any other suitable shape or orientation such as a vertical wellbore, an offset wellbore, a curved wellbore, and the like.

In some examples, the first wellbore 204*a* may be or include an injection wellbore, and the second wellbore 204*b* may be or include a production wellbore, though the reverse configuration is also possible. The first wellbore 204*a* may include a first flow control device 206*a*, a second flow control device 206*b*, and a third flow control device 206*c*, though any other suitable numbers (e.g., less than three or more than three) of flow control devices can be included in the first wellbore 204*a*. The first flow control device 206*a*, the second flow control device 206*b*, the third flow control device 206*c*, or any combination thereof may be or include a nozzle inflow control device, an electric inflow control device, or any other flow control device or combination of flow control devices that can inject fluid, such as wellbore fluid, into the geological formation 202. Additionally or alternatively, the second wellbore 204*b* may include a fourth flow control device 206*d*, a fifth flow control device 206*e*, and a sixth flow control device 206*f*, though any other suitable numbers (e.g., less than three or more than three) of flow control devices can be included in the second wellbore 204*b*. In some examples, the first wellbore 204*a* may have a different number of flow control devices than a number of flow control devices included in the second wellbore 204*b*. The fourth flow control device 206*d*, the fifth flow control device 206*e*, the sixth flow control device 206*f*, or any combination thereof may be or include a nozzle inflow control device, an electric inflow control device, or any other flow control device or combination of flow control devices that can choke or produce material, such as hydrogen-containing material, hydrocarbon material, water, brine, and the like, with respect to the geological formation 202.

The first flow control device 206*a*, the second flow control device 206*b*, the third flow control device 206*c*, or any combination thereof can be positioned offset in the first wellbore 204*a*. For example, the first wellbore 204*a* may include or may define isolated zones 208*a-c*, and first flow control device 206*a*, the second flow control device 206*b*, and the third flow control device 206*c* may be positioned in corresponding isolated zones of the isolated zones 208*a-c*. The first flow control device 206*a* may be positioned at a first location 210*a* in the first wellbore 204*a*, and a first isolated zone 208*a* of the first wellbore 204*a* may surround the first location 210*a*. Additionally or alternatively, the second flow control device 206*b* may be positioned at a second location 210*b* in the first wellbore 204*a*, and a second isolated zone 208*b* of the first wellbore 204*a* may surround the second location 210*b*. Additionally or alternatively, the third flow control device 206*c* may be positioned at a third location 210*c* in the first wellbore 204*a*, and a third isolated zone 208*c* of the first wellbore 204*a* may surround the third location 210*c*. The first location 210*a* may be offset from the second location 210*b* and the third location 210*c* (or any permutation thereof) in a direction that follows the path of a first axis 212*a* of the first wellbore 204*a*.

The fourth flow control device 206*d*, the fifth flow control device 206*e*, the sixth flow control device 206*f*, or any combination thereof can be positioned offset in the second wellbore 204*b*. For example, the second wellbore 204*b* may include or may define isolated zones 208*d-f*, and fourth flow control device 206*d*, the fifth flow control device 206*e*, and the sixth flow control device 206*f* may be positioned in corresponding isolated zones of the isolated zones 208*d-f*. The fourth flow control device 206*d* may be positioned at a fourth location 210*d* in the second wellbore 204*b*, and a fourth isolated zone 208*d* of the second wellbore 204*b* may surround the fourth location 210*d*. Additionally or alternatively, the fifth flow control device 206*e* may be positioned at a fifth location 210*e* in the second wellbore 204*b*, and a fifth isolated zone 208*e* of the second wellbore 204*b* may surround the fifth location 210*e*. Additionally or alternatively, the sixth flow control device 206*f* may be positioned at a sixth location 210*f* in the second wellbore 204*b*, and a sixth isolated zone 208*f* of the second wellbore 204*b* may surround the sixth location 210*f*. The fourth location 210*d* may be offset from the fifth location 210*e* and the sixth location 210*f* (or any permutation thereof) in a direction that follows the path of a second axis 212*b* of the second wellbore 204*b*.

The first flow control device 206*a*, the second flow control device 206*b*, the third flow control device 206*c*, the fourth flow control device 206*d*, the fifth flow control device 206*e*, the sixth flow control device 206*f*, or any combination thereof may be used to control flow of one or more materials with respect to the set of wellbores 200, the geological formation 202, or a combination thereof. For example, the first flow control device 206*a*, the second flow control device 206*b*, the third flow control device 206*c*, or any combination thereof may inject fluid, such as wellbore fluid, into the geological formation 202 to stimulate production of one or more materials from the geological formation 202. For example, the first flow control device 206*a*, the second flow control device 206*b*, the third flow control device 206*c*, or any combination thereof may inject the wellbore fluid into the geological formation 202 to enhance the following reaction for producing hydrogen:

$$3Fe_2SiO_4+2H_2O \rightarrow 3SiO_2+2Fe_3O_4+2H_2 \quad \text{(Equation 1)}$$

Additionally or alternatively, the fourth flow control device 206*d*, the fifth flow control device 206*e*, the sixth flow control device 206*f*, or any combination thereof may receive one or more materials from the geological formation 202. The one or more materials may be or include hydrogen, such as geological hydrogen, hydrocarbon material, brine, or the like. The fourth flow control device 206*d*, the fifth flow control device 206*e*, the sixth flow control device 206*f*, or any combination thereof may determine whether to produce or choke the one or more materials based on one or more properties, such as fluid properties or gas properties, associated with the one or more materials. For example, the fourth flow control device 206*d* may receive a first material, such as oil, and determine to choke the first material based on a density, a viscosity, a composition, or other suitable property of the first material. Additionally or alternatively, the fifth flow control device 206*e* may receive a second material, such as brine, and determine to choke the second material based on a density, a viscosity, a composition, or other suitable property of the second material. Additionally or alternatively, the sixth flow control device 206*f* may receive a third material, such as geological hydrogen, and determine to produce the third material based on a density, a viscosity, a composition, or other suitable property of the third material.

Figure 3:
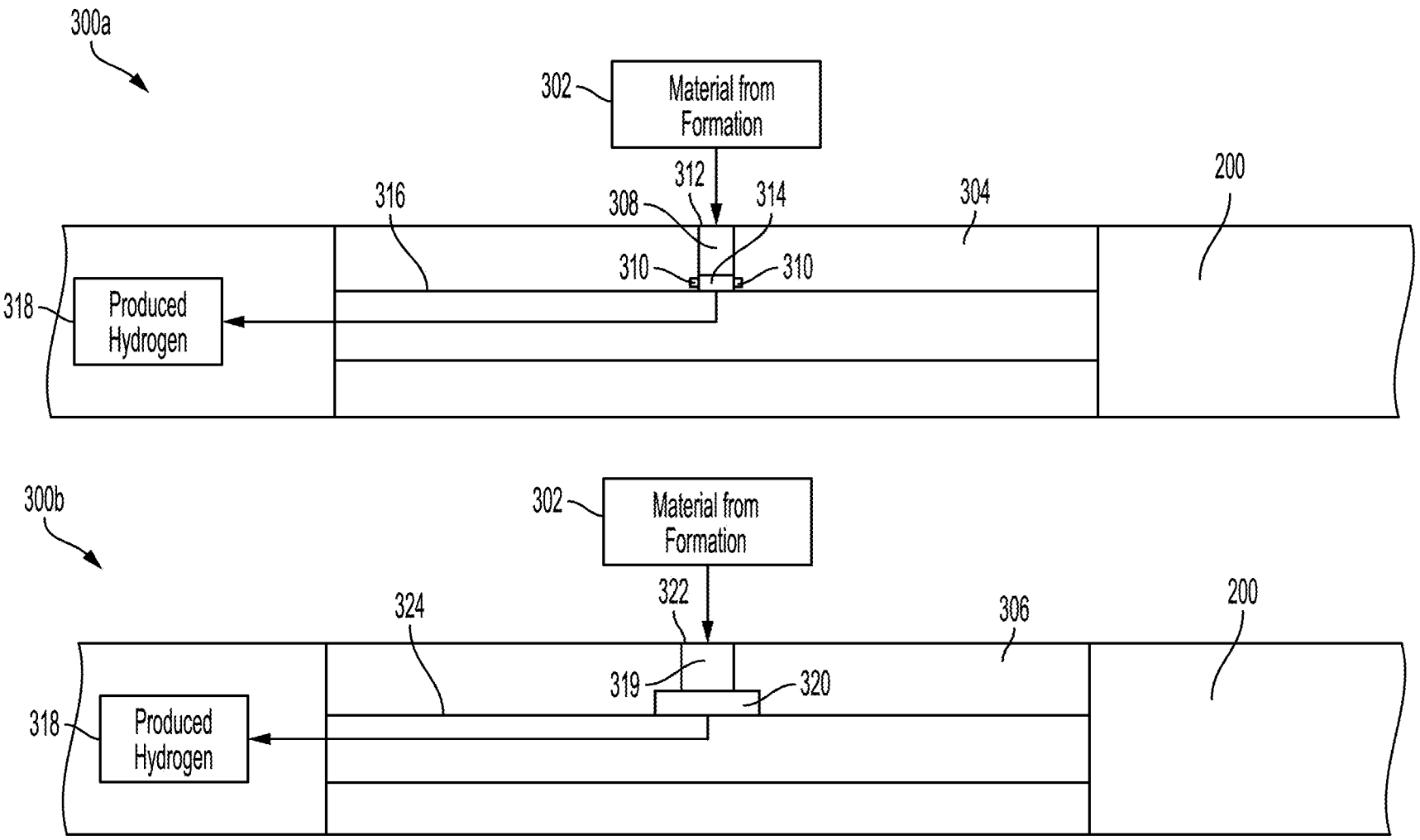
FIG. 3 is a set of block diagrams of flow of material from a subterranean formation with respect to a set of flow control devices according to one example of the present disclosure.

FIG. 3 is a set of block diagrams 300 of flow of material from a geological formation with respect to a set of flow control devices according to one example of the present disclosure. In some examples, the block diagram 300*a* may illustrate flow of material 302 with respect to an electric inflow control device 304, and the block diagram 300*b* may illustrate flow of the material 302 with respect to a density automatic inflow control device 306. As illustrated in the block diagram 300*a*, the electric inflow control device 304 may be positioned in a wellbore 100 or in a set of wellbores 200. The electric inflow control device 304 may include a receiving path 308, a set of sensors 310, and any other suitable component for providing functionality for the electric inflow control device 304. The receiving path 308 may extend from an external surface 312 of the electric inflow control device 304 to a valve 314 that may be located adjacent to the set of sensors 310.

The material 302 may enter the electric inflow control device 304 via the receiving path 308 and may contact the valve 314. The set of sensors 310, which may be or include temperature sensors, composition sensors, density sensors, and the like, may detect one or more properties of the material 302 and may cause the electric inflow control device 304 to determine whether to produce or choke the material 302 by retaining the valve 314 closed or opening the valve 314, respectively. If the set of sensors 310 detects the one or more properties indicating that the material 302 is, or is likely to be, hydrogen such as geological hydrogen, then the electric inflow control device 304 may, for example using electrical power, cause the valve 314 to open and may produce the material 302. If the set of sensors 310 detects the one or more properties indicating that the material 302 is not, or is not likely to include, hydrogen, then the electric inflow control device 304 may cause the valve 314 to remain closed and may choke the material 302. In examples in which the valve 314 is opened, the material 302 may proceed into a production bore 316 and can be produced as produced hydrogen 318. In examples in which the valve 314 remains closed, the material 302 may not proceed to the production bore 316 and may be choked.

As illustrated in the block diagram 300*b*, the density automatic inflow control device 306 may be positioned in the wellbore 100 or in the set of wellbores 200. The density automatic inflow control device 306 may include a receiving path 319, a rotatable component 320, and any other suitable component for providing functionality for the density automatic inflow control device 306. The receiving path 308 may extend from an external surface 322 of the density automatic inflow control device 306 to the rotatable component 320 that may be located adjacent to a production bore 324 of the density automatic inflow control device 306.

The material 302 may enter the density automatic inflow control device 306 via the receiving path 319 and may contact the rotatable component 320. The rotatable component 320 may initially be in a closed state and may rotate to open and allow the material 302 to flow into the production bore 324 of the density automatic inflow control device 306 based on one or more properties of the material 302. For example, if the material 302 has a density that exceeds a threshold density, then the rotatable component 320 may, for example using mechanical power supplied by the material 302, open and may allow the density automatic inflow control device 306 to produce the material 302. The threshold density may be a density that indicates a material is likely to have a significant concentration of hydrogen. If the material 302 has a density that does not exceed the threshold density, then the rotatable component 320 may remain closed and may cause the density automatic inflow control device 306 to choke the material 302. In examples in which the rotatable component 320 opens, the material 302 may proceed into the production bore 324 and can be produced as produced hydrogen 318. In examples in which the rotatable component 320 remains closed, the material 302 may not proceed to the production bore 324 and may be choked.

Figure 4:
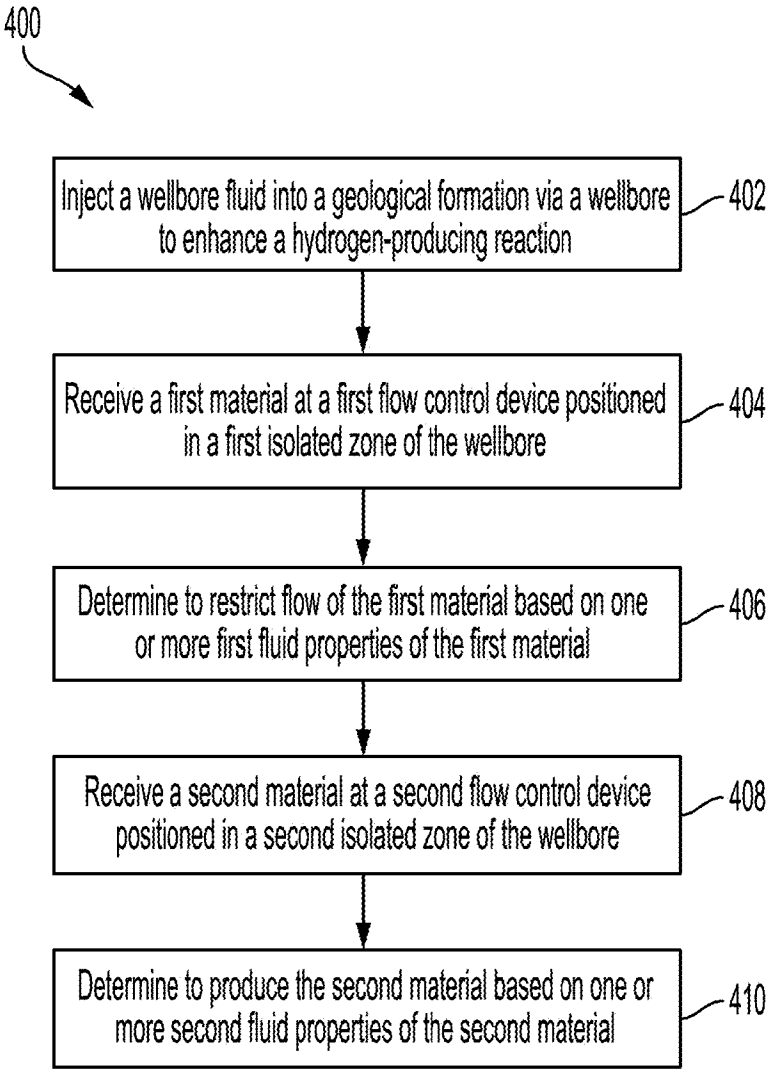
FIG. 4 is a flowchart of a process to produce hydrogen from a wellbore with a set of flow control devices according to one example of the present disclosure.

FIG. 4 is a flowchart of a process 400 to produce hydrogen from a wellbore 100 with a set of flow control devices according to one example of the present disclosure. At block 402, wellbore fluid is injected into a geological formation, such as the geological formation 202, to enhance a hydrogen-producing reaction. In some examples, the hydrogen-producing reaction can be or can involve Equation 1. The geological formation may include one wellbore, such as the wellbore 100, or may include more than one wellbore such as the set of wellbores 200. One or more flow control devices, such as the first downhole tool 104*a*, the second downhole tool 104*b*, the first flow control device 206*a*, the second flow control device 206*b*, the third flow control device 206*c*, or any combination thereof, may inject the wellbore fluid into the geological formation. In some examples, the one or more flow control devices may be or include a nozzle inflow control device that can inject fluid into the geological formation. Additionally or alternatively, the wellbore fluid may be or include water, brine, artificially generated wellbore fluid, or any combination thereof.

At block 404, a first flow control device, such as the first downhole tool 104*a*, the fourth flow control device 206*d*, or other suitable flow control devices, may receive a first material from the geological formation. The first flow control device may be positioned in a first isolated zone of the wellbore. The first material may be or include hydrogen, such as geological hydrogen, hydrocarbon material, brine, water, gas, or the like. The first flow control device may be or include a density automatic flow control device, an electric inflow control device, or the like.

At block 406, the first flow control device determines to restrict flow of the first material based at least in part on one or more properties, such as fluid properties or gas properties, of the first material. The first flow control device may identify the first material, may infer one or more properties of the first material, or the like to determine whether to restrict the flow of the first material. For example, if the first flow control device is an electric inflow control device, then the first flow control device may use one or more sensors, lasers, and the like to identify at least an approximate composition of the first material, at least a set of properties associated with the first material, and the like. In this example, the first flow control device may receive the first material and may measure a hydrogen content of the first material or a concentration of hydrogen included in the first material. The first flow control device may identify that the first material includes no hydrogen, or the first flow control device may identify that the first material includes negligible, or insignificant amounts (e.g., less than approximately 40%, less than approximately 20%, less than approximately 10%, less than approximately 5%, less than approximately 1%, less than approximately 0.1%, etc.), of hydrogen.

In other examples, the first flow control device may be or include a density automatic inflow control device. In these examples, the first flow control device may produce material or choke material mechanically based on a density of received material. The first flow control device can receive the first material, and, if the first material has a density that exceeds a threshold density, then the first flow control device may produce or encourage production of the first material. If the first material has a density that does not exceed the threshold density, then the first flow control device may choke or otherwise restrict production of the first material. At the block 406, the first flow control device may restrict production of the first material in response to the first flow control device receiving the first material and the first material not having a density that exceeds the density threshold. In some examples, the density threshold may be similar or identical to an expected density of hydrogen or a hydrogen-containing material that includes a significant concentration (e.g., greater than approximately 10%, greater than approximately 20%, greater than approximately 50%, greater than approximately 75%, etc.) of hydrogen.

At block 408, a second flow control device, such as the second downhole tool 104*b*, the fifth flow control device 206*e*, or the like, receives a second material. The second flow control device may be positioned in a wellbore, such as the wellbore 100 or the set of wellbores 200, and may be positioned in a second particular isolated zone of the wellbore. The second flow control device may be positioned offset, such as along an axis of the wellbore, from the first flow control device and may be positioned in or adjacent to a different isolated zone of the wellbore with respect to the first flow control device.

The second flow control device may be or include an electric inflow control device, a density automatic inflow control device, a viscosity automatic inflow control device, or any other suitable type of flow control device that can be positioned and used in the wellbore. In some examples, the second flow control device may be the same or similar type of flow control device as the first flow control device. In other examples, the second flow control device may be different than the first flow control device. The second flow control device may receive the second material via or from the second particular isolated zone. In some examples, the second material may be or include hydrogen or a hydrogen-gas-containing material. The second material may include significant concentrations (e.g., greater than approximately 5%, greater than approximately 10%, greater than approximately 20%, greater than approximately 40%, greater than approximately 75%, etc.) of hydrogen. The second flow control device may receive the second material at a valve or other actuatable component that may allow the second flow control device to choke or produce the first material.

At block 410, the second flow control device determines to produce the second material based on one or more properties, such as fluid properties or gas properties, of the second material. The second flow control device may identify the second material, may infer the one or more properties of the second material, or the like to determine whether to produce or encourage the flow of the second material. For example, if the second flow control device is an electric inflow control device, then the second flow control device may use one or more sensors, lasers, and the like to identify at least an approximate composition of the second material, at least a set of properties associated with the second material, and the like. In this example, the second flow control device may receive the second material and may measure a hydrogen content of the second material or a concentration of hydrogen included in the second material. The second flow control device may identify that the second material includes significant amounts (e.g., greater than approximately 5%, greater than approximately 10%, greater than approximately 20%, greater than approximately 40%, greater than approximately 75%, etc.) of hydrogen.

In other examples, the second flow control device may be or include a density automatic inflow control device. In these examples, the second flow control device may produce material or choke material mechanically based on a density of received material. The second flow control device can receive the second material, and, if the second material has a density that exceeds a threshold density, then the second flow control device may produce or encourage production of the second material. If the second material has a density that does not exceed the threshold density, then the second flow control device may choke or otherwise restrict production of the second material. At the block 410, the second flow control device may produce or encourage production of the second material in response to the second flow control device receiving the second material and the second material having a density that exceeds the threshold density. In some examples, the density threshold may be similar or identical to an expected density of hydrogen or a hydrogen-gas-containing material that includes a significant concentration (e.g., greater than approximately 10%, greater than approximately 20%, greater than approximately 50%, greater than approximately 75%, etc.) of hydrogen.

Figure 5:
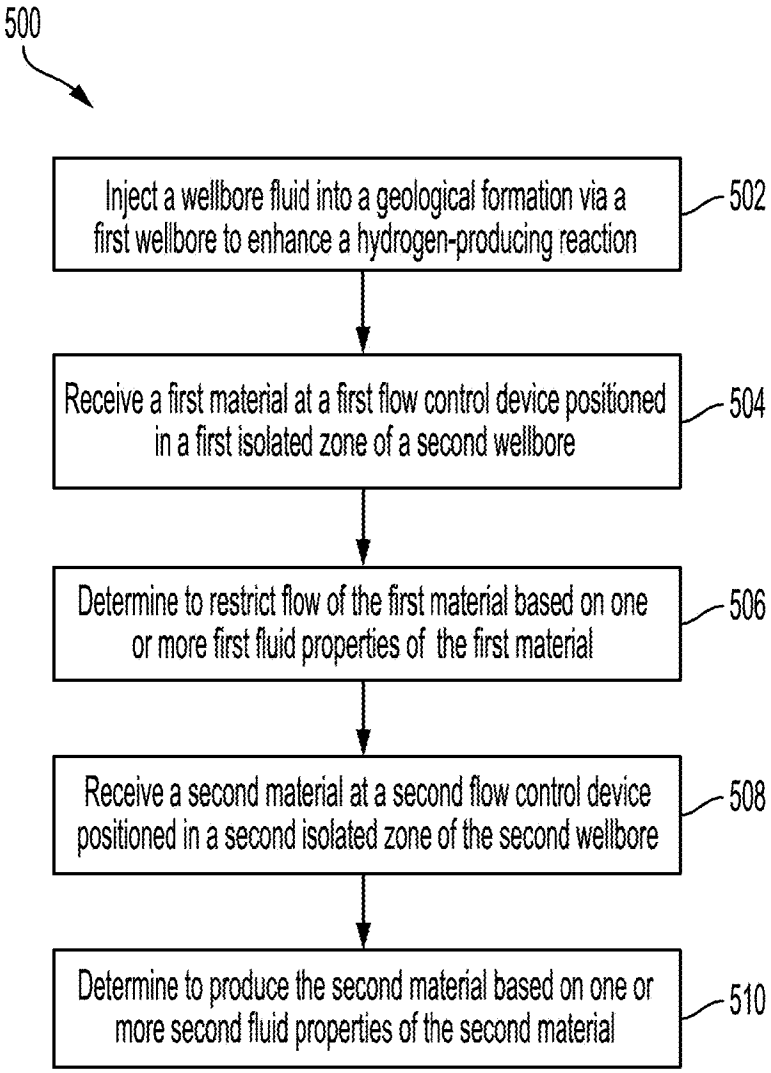
FIG. 5 is a flowchart of a process to produce hydrogen using a system of wellbores with a set of flow control devices according to one example of the present disclosure.

FIG. 5 is a flowchart of a process 500 to produce hydrogen using a set of wellbores 200 with a set of flow control devices according to one example of the present disclosure. At block 502, wellbore fluid is injected into a geological formation, such as the geological formation 202, from a first wellbore, such as the first wellbore 204*a*, to enhance a hydrogen-producing reaction. In some examples, the hydrogen-producing reaction can be or can involve Equation 1. The geological formation may include more than one wellbore such as the set of wellbores 200. One or more flow control devices, such as the first flow control device 206*a*, the second flow control device 206*b*, the third flow control device 206*c*, or any combination thereof, may inject the wellbore fluid into the geological formation. In some examples, the one or more flow control devices may be or include a nozzle inflow control device that can inject fluid into the geological formation. Additionally or alternatively, the wellbore fluid may be or include water, brine, artificially generated wellbore fluid, or any combination thereof.

At block 504, a first flow control device, such as the fourth flow control device 206*d*, receives a first material. The first flow control device may be positioned in a second wellbore, such as the second wellbore 204*b*, and may be positioned in a particular isolated zone of the second wellbore. The first flow control device may be or include an electric inflow control device, a density automatic inflow control device, a viscosity automatic inflow control device, or any other suitable type of flow control device that can be positioned and used in the wellbore. The first flow control device may receive the first material via or from the particular isolated zone. In some examples, the first material may be or include brine, a hydrocarbon material, such as oil or gas, water, or the like. The first material may include low concentrations (e.g., less than 40%, less than 20%, less than 10%, less than 5%, less than 1%, etc.), or negligible amounts, of hydrogen or hydrogen-gas-containing material. The first flow control device may receive the first material at a valve or other actuatable component that may allow the first flow control device to choke or produce the first material.

At block 506, the first flow control device determines to restrict flow of the first material based at least in part on one or more properties, such as fluid properties or gas properties, of the first material. The first flow control device may identify the first material, may infer one or more properties of the first material, or the like to determine whether to restrict the flow of the first material. For example, if the first flow control device is an electric inflow control device, then the first flow control device may use one or more sensors, lasers, and the like to identify at least an approximate composition of the first material, at least a set of fluid properties or gas properties associated with the first material, and the like. In this example, the first flow control device may receive the first material and may measure a hydrogen content of the first material or a concentration of hydrogen included in the first material. The first flow control device may identify that the first material includes no hydrogen or other hydrogen-gas-containing material, or the first flow control device may identify that the first material includes negligible, or insignificant amounts (e.g., less than approximately 40%, less than approximately 20%, less than approximately 10%, less than approximately 5%, less than approximately 1%, less than approximately 0.1%, etc.), of hydrogen.

In other examples, the first flow control device may be or include a density automatic inflow control device. In these examples, the first flow control device may produce material or choke material mechanically based on a density of received material. The first flow control device can receive the first material, and, if the first material has a density that exceeds a threshold density, then the first flow control device may produce or encourage production of the first material. If the first material has a density that does not exceed the threshold density, then the first flow control device may choke or otherwise restrict production of the first material. At the block 506, the first flow control device may restrict production of the first material in response to the first flow control device receiving the first material and the first material not having a density that exceeds the density threshold. In some examples, the density threshold may be similar or identical to an expected density of hydrogen or hydrogen-gas-containing material that includes a significant concentration (e.g., greater than approximately 10%, greater than approximately 20%, greater than approximately 50%, greater than approximately 75%, etc.) of hydrogen.

At block 508, a second flow control device, such as the fifth flow control device 206*e*, receives a second material. The second flow control device may be positioned in the second wellbore and may be positioned in a second particular isolated zone of the second wellbore. The second flow control device may be positioned offset, such as along an axis, such as the second axis 212*b*, of the second wellbore, from the first flow control device and may be positioned in or adjacent to a different isolated zone of the wellbore with respect to the first flow control device.

The second flow control device may be or include an electric inflow control device, a density automatic inflow control device, a viscosity automatic inflow control device, or any other suitable type of flow control device that can be positioned and used in the wellbore. In some examples, the second flow control device may be the same or similar type of flow control device as the first flow control device. In other examples, the second flow control device may be different than the first flow control device. The second flow control device may receive the second material via or from the second particular isolated zone. In some examples, the second material may be or include hydrogen or a hydrogen-gas-containing material. The second material may include significant concentrations (e.g., greater than approximately 5%, greater than approximately 10%, greater than approximately 20%, greater than approximately 40%, greater than approximately 75%, etc.) of hydrogen. The second flow control device may receive the second material at a valve or other actuatable component that may allow the second flow control device to choke or produce the first material.

At block 510, the second flow control device determines to produce the second material based on one or more properties, such as fluid properties or gas properties, of the second material. The second flow control device may identify the second material, may infer the one or more properties of the second material, or the like to determine whether to produce or encourage the flow of the second material. For example, if the second flow control device is an electric inflow control device, then the second flow control device may use one or more sensors, lasers, and the like to identify at least an approximate composition of the second material, at least a set of fluid properties associated with the second material, and the like. In this example, the second flow control device may receive the second material and may measure a hydrogen content of the second material or a concentration of hydrogen included in the second material. The second flow control device may identify that the second material includes significant amounts (e.g., greater than approximately 5%, greater than approximately 10%, greater than approximately 20%, greater than approximately 40%, greater than approximately 75%, etc.) of hydrogen.

In other examples, the second flow control device may be or include a density automatic inflow control device. In these examples, the second flow control device may produce material or choke material mechanically based on a density of received material. The second flow control device can receive the second material, and, if the second material has a density that exceeds a threshold density, then the second flow control device may produce or encourage production of the second material. If the second material has a density that does not exceed the threshold density, then the second flow control device may choke or otherwise restrict production of the second material. At the block 510, the second flow control device may produce or encourage production of the second material in response to the second flow control device receiving the second material and the second material having a density that exceeds the threshold density. In some examples, the density threshold may be similar or identical to an expected density of hydrogen or hydrogen-gas-containing material that includes a significant concentration (e.g., greater than approximately 10%, greater than approximately 20%, greater than approximately 50%, greater than approximately 75%, etc.) of hydrogen.

In some aspects, systems and methods for flow control devices for hydrogen production from a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first flow control device positionable in a wellbore, which is positioned in a geological formation, to control flow of a first material, based on one or more first fluid properties of the first material, with respect to a first isolated zone of the wellbore; and a second flow control device positionable in the wellbore offset from the first flow control device to control flow of a second material, based on one or more second fluid properties of the second material, with respect to a second isolated zone of the wellbore, the second material being different than the first material and comprising hydrogen, wherein the flow of the first material and the flow of the second material are controllable in response to wellbore fluid being injected into the geological formation to enhance a hydrogen-producing reaction.

Example 2 is the system of example 1, wherein the first flow control device and the second flow control device are usable to inject the wellbore fluid into the geological formation to enhance the hydrogen-producing reaction, and wherein the wellbore fluid comprises water, brine, or an artificial wellbore fluid.

Example 3 is the system of example 1, wherein the first material comprises hydrocarbon material or brine, and wherein the second material is $H_2$.

Example 4 is the system of example 1, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

Example 5 is the system of example 1, wherein flow of the first material is controllable by the first flow control device to choke the first material from being produced via the wellbore, and wherein flow of the second material is controllable by the second flow control device to produce the second material from the wellbore.

Example 6 is the system of example 1, wherein the flow of the first material with respect to the wellbore is controllable by the first flow control device using a density of the first material, a viscosity of the first material, or a measured level of hydrogen of the first material, and wherein the flow of the second material with respect to the wellbore is controllable by the second flow control device using a density of the second material, a viscosity of the second material, or a measured level of hydrogen of the second material.

Example 7 is the system of any of examples 1 and 6, wherein the first flow control device comprises an electric inflow control device or a density automatic inflow control device, and wherein the second flow control device comprises an electric inflow control device or a density automatic inflow control device.

Example 8 is a method comprising: injecting, via a wellbore positioned in a geological formation, a wellbore fluid into the geological formation to enhance a hydrogen-producing reaction; receiving a first material at a first flow control device positioned in a first isolated zone of the wellbore; determining, based on one or more first fluid properties of the first material, to restrict production of the first material via the wellbore; receiving a second material at a second flow control device positioned in a second isolated zone of the wellbore, the second material different than the first material and comprising hydrogen; and determining, based on one or more second fluid properties of the second material, to produce the second material via the wellbore.

Example 9 is the method of example 8, wherein injecting the wellbore fluid into the geological formation comprises using the first flow control device and the second flow control device to inject the wellbore fluid into the geological formation, and wherein the first flow control device and the second flow control device comprise a nozzle inflow control device.

Example 10 is the method of example 8, wherein the first material comprises hydrocarbon material or brine, and wherein the second material is $H_2$.

Example 11 is the method of example 8, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

Example 12 is the method of example 8, wherein determining to restrict the production of the first material comprises identifying a density of the first material, a viscosity of the first material, or a measured level of hydrogen of the first material, and wherein determining to produce the second material comprises identifying a density of the second material, a viscosity of the second material, or a measured level of hydrogen of the second material.

Example 13 is the method any of examples 8 and 12, wherein the first flow control device comprises an electric inflow control device or a density automatic inflow control device, and wherein the second flow control device comprises an electric inflow control device or a density automatic inflow control device.

Example 14 is the method of any of examples 8 and 12-13, wherein the first flow control device is approximately the same as the second flow control device.

Example 15 is a system comprising: a first set of flow control devices located in a first wellbore that is positioned in a geological formation, the first set of flow control devices usable to inject wellbore fluid into the geological formation to enhance a hydrogen-producing reaction; and a second set of flow control devices located in a second wellbore that is positioned in the geological formation offset from the first wellbore, the second set of flow control devices comprising: a first flow control device to control flow of a first material, based on one or more first fluid properties of the first material, with respect to a first isolated zone of the second wellbore; and a second flow control device located offset from the first flow control device to control flow of a second material, based on one or more second fluid properties of the second material, with respect to a second isolated zone of the second wellbore, the second material being different than the first material and comprising hydrogen, wherein the flow of the first material and the flow of the second material are controllable in response to the wellbore fluid being injected into the geological formation.

Example 16 is the system of example 15, wherein the first material comprises hydrocarbon material or brine, and wherein the second material is $H_2$, and wherein the wellbore fluid comprises water, brine, or an artificial wellbore fluid.

Example 17 is the system of example 15, wherein the first flow control device is located at a first location in the second wellbore, wherein the second flow control device is located at a second location in the second wellbore, wherein the first location is offset from the second location along an axis that follows a path of the second wellbore, wherein the first isolated zone surrounds the first location, and wherein the second isolated zone surrounds the second location.

Example 18 is the system of example 15, wherein flow of the first material is controllable by the first flow control device to choke the first material from being produced via the second wellbore, and wherein flow of the second material is controllable by the second flow control device to produce the second material from the second wellbore.

Example 19 is the system of example 15, wherein the flow of the first material with respect to the second wellbore is controllable by the first flow control device using a density of the first material, a viscosity of the first material, or a measured level of hydrogen in the first material, and wherein the flow of the second material with respect to the second wellbore is controllable by the second flow control device using a density of the second material, a viscosity of the second material, or a measured level of hydrogen in the second material.

Example 20 is the system of example 15, wherein the first flow control device comprises an electric inflow control device or a density automatic inflow control device, wherein the second flow control device comprises an electric inflow control device or a density automatic inflow control device, and wherein the first set of flow control devices comprises one or more nozzle inflow control devices.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a first flow control device positionable in a wellbore, which is positioned in a geological formation, to control flow of a first material, based on one or more first fluid properties of the first material, with respect to a first isolated zone of the wellbore; and a second flow control device positionable in the wellbore offset from the first flow control device to control flow of a second material, based on one or more second fluid properties of the second material, with respect to a second isolated zone of the wellbore, the second material being different than the first material and comprising hydrogen, wherein the flow of the first material and the flow of the second material are controllable in response to wellbore fluid being injected into the geological formation to enhance a hydrogen-producing reaction, the first flow control device or the second flow control device comprising an electric inflow control device that is positionable to determine a concentration of hydrogen to control flow of the first material or the second material.

2. The system of claim 1, wherein the first flow control device and the second flow control device are usable to inject the wellbore fluid into the geological formation to enhance the hydrogen-producing reaction, and wherein the wellbore fluid comprises water, brine, or an artificial wellbore fluid.

3. The system of claim 1, wherein the first material comprises hydrocarbon material or brine, and wherein the second material is $H_2$.

4. The system of claim 1, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

5. The system of claim 1, wherein flow of the first material is controllable by the first flow control device to choke the first material from being produced via the wellbore, and wherein flow of the second material is controllable by the second flow control device to produce the second material from the wellbore.

6. The system of claim 1, wherein the flow of the first material with respect to the wellbore is controllable by the first flow control device using a density of the first material, a viscosity of the first material, or a measured level of hydrogen of the first material, and wherein the flow of the second material with respect to the wellbore is controllable by the second flow control device using a density of the second material, a viscosity of the second material, or a measured level of hydrogen of the second material.

7. The system of claim 6, wherein the first flow control device comprises a density automatic inflow control device, and wherein the second flow control device comprises a density automatic inflow control device.

8. A method comprising:

injecting, via a wellbore positioned in a geological formation, a wellbore fluid into the geological formation to enhance a hydrogen-producing reaction;

receiving a first material at a first flow control device positioned in a first isolated zone of the wellbore;

determining, based on one or more first fluid properties of the first material, to restrict production of the first material via the wellbore;

receiving a second material at a second flow control device positioned in a second isolated zone of the wellbore, the second material different than the first material and comprising hydrogen, the first flow control device or the second flow control device comprising an electric inflow control device that is positioned to determine a concentration of hydrogen to control flow of the first material or the second material; and determining, based on one or more second fluid properties of the second material, to produce the second material via the wellbore.

9. The method of claim 8, wherein injecting the wellbore fluid into the geological formation comprises using the first flow control device and the second flow control device to inject the wellbore fluid into the geological formation, and wherein the first flow control device and the second flow control device comprise a nozzle inflow control device.

10. The method of claim 8, wherein the first material comprises hydrocarbon material or brine, and wherein the second material is $H_2$.

11. The method of claim 8, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

12. The method of claim 8, wherein determining to restrict the production of the first material comprises identifying a density of the first material, a viscosity of the first material, or a measured level of hydrogen of the first material, and wherein determining to produce the second material comprises identifying a density of the second material, a viscosity of the second material, or a measured level of hydrogen of the second material.

13. The method of claim 12, wherein the first flow control device comprises a density automatic inflow control device, and wherein the second flow control device comprises a density automatic inflow control device.

14. The method of claim 13, wherein the first flow control device is approximately the same as the second flow control device.

15. A system comprising:

a first set of flow control devices located in a first wellbore that is positioned in a geological formation, the first set of flow control devices usable to inject wellbore fluid into the geological formation to enhance a hydrogen-producing reaction; and a second set of flow control devices located in a second wellbore that is positioned in the geological formation offset from the first wellbore, the second set of flow control devices comprising:

a first flow control device to control flow of a first material, based on one or more first fluid properties of the first material, with respect to a first isolated zone of the second wellbore; and a second flow control device located offset from the first flow control device to control flow of a second material, based on one or more second fluid properties of the second material, with respect to a second isolated zone of the second wellbore, the second material being different than the first material and comprising hydrogen, wherein the flow of the first material and the flow of the second material are controllable in response to the wellbore fluid being injected into the geological formation, the first flow control device or the second flow control device comprising an electric inflow control device that is positionable to determine a concentration of hydrogen to control flow of the first material or the second material.

16. The system of claim 15, wherein the first material comprises hydrocarbon material or brine, and wherein the second material is $H_2$, and wherein the wellbore fluid comprises water, brine, or an artificial wellbore fluid.

17. The system of claim 15, wherein the first flow control device is located at a first location in the second wellbore, wherein the second flow control device is located at a second location in the second wellbore, wherein the first location is offset from the second location along an axis that follows a path of the second wellbore, wherein the first isolated zone surrounds the first location, and wherein the second isolated zone surrounds the second location.

18. The system of claim 15, wherein flow of the first material is controllable by the first flow control device to choke the first material from being produced via the second wellbore, and wherein flow of the second material is controllable by the second flow control device to produce the second material from the second wellbore.

19. The system of claim 15, wherein the flow of the first material with respect to the second wellbore is controllable by the first flow control device using a density of the first material, a viscosity of the first material, or a measured level of hydrogen in the first material, and wherein the flow of the second material with respect to the second wellbore is controllable by the second flow control device using a density of the second material, a viscosity of the second material, or a measured level of hydrogen in the second material.

20. The system of claim 15, wherein the first flow control device comprises a density automatic inflow control device, wherein the second flow control device comprises a density automatic inflow control device, and wherein the first set of flow control devices comprises one or more nozzle inflow control devices.

* * * * *